US011298595B2

(12) United States Patent
Barahona Torres

(10) Patent No.: US 11,298,595 B2
(45) Date of Patent: Apr. 12, 2022

(54) SPORTS RACQUET

(71) Applicant: Miguel Angel Barahona Torres, Houston, TX (US)

(72) Inventor: Miguel Angel Barahona Torres, Houston, TX (US)

( * ) Notice: Subject to any disclaimer, the term of this patent is extended or adjusted under 35 U.S.C. 154(b) by 0 days.

(21) Appl. No.: 15/415,280

(22) Filed: Jan. 25, 2017

(65) Prior Publication Data

US 2017/0157470 A1 Jun. 8, 2017

Related U.S. Application Data

(63) Continuation-in-part of application No. 14/686,959, filed on Apr. 15, 2015, now abandoned.

(51) Int. Cl.

| | |
|---|---|
| ***A63B 49/12*** | (2015.01) |
| ***A63B 49/10*** | (2015.01) |
| ***A63B 49/02*** | (2015.01) |
| ***A63B 49/08*** | (2015.01) |
| ***A63B 60/34*** | (2015.01) |

(52) U.S. Cl.

CPC ..... *A63B 49/12* (2013.01); *A63B 49/02* (2013.01); *A63B 49/08* (2013.01); *A63B 49/10* (2013.01); *A63B 60/34* (2015.10); *A63B 2049/0201* (2015.10); *A63B 2049/0203* (2015.10); *A63B 2049/0204* (2015.10); *A63B 2049/0207* (2015.10)

(58) Field of Classification Search

CPC ..... A63B 2049/0202–007; A63B 2049/0211–0214; A63B 2049/0217

USPC ..... 473/546, 463, 524, 537

See application file for complete search history.

(56) References Cited

U.S. PATENT DOCUMENTS

| | | | | | |
|---|---|---|---|---|---|
| 4,147,348 | A * | 4/1979 | Lee | A63B 49/08 | 16/DIG. 12 |
| 4,346,891 | A * | 8/1982 | Epstein | A63B 49/00 | 473/537 |
| 4,360,201 | A * | 11/1982 | Biehl | A63B 49/08 | 473/526 |
| 4,478,416 | A * | 10/1984 | Gibello | A63B 60/34 | 473/526 |
| 4,659,080 | A * | 4/1987 | Stoller | A63B 60/34 | 473/526 |
| 5,364,103 | A * | 11/1994 | Chen | A63B 67/002 | 473/219 |
| 6,083,125 | A * | 7/2000 | West | A63B 49/08 | 473/526 |
| 2005/0137039 | A1* | 6/2005 | Filippini | A63B 49/02 | 473/524 |
| 2010/0248859 | A1* | 9/2010 | Kim | A63B 60/00 | 473/332 |

* cited by examiner

*Primary Examiner* — John E Simms, Jr.
*Assistant Examiner* — Rayshun K Peng
(74) *Attorney, Agent, or Firm* — Benjamin Aaron Adler

(57) ABSTRACT

Provided herein are racquets, such as sports racquets. The racquets generally comprise a head frame with a curved side portion and a straight top portion and a curved bottom portion and handle affixed to the head frame between the top portion and portion. A plurality of openings is equally spaced through the head frame and a portion of the handle and a plurality of strings comprising a net pass through the openings. The length of the top rim of the head frame is greater than the bottom rim. The handle connects to the head frame at an angle of about 140° to 150°.

14 Claims, 5 Drawing Sheets

SPORTS RACQUET

CROSS-REFERENCE TO RELATED APPLICATION

This application is a continuation-in-part under 35 U.S.C. § 120 of pending non-provisional application U.S. Ser. No. 14/686,959, filed Apr. 15, 2015, the entirety of which is hereby incorporated by reference.

BACKGROUND OF THE INVENTION

Field of the Invention

The present invention relates generally to the field of sports equipment. More specifically, the present invention relates to ball racquets that specifically accommodate to the shape of the ball and the comfort level of the users.

Description of the Related Art

A racquet is often used in a ball game to hit or control a ball, and propel it toward the opponents or a goal. Generally, racquets comprise a head frame, a handle, and a net disposed within the head frame. Many racquets for different types of games share similar shapes and structures with a circular or elliptical shaped head frame and a straight handle. The handle of the racquet often passes the central line of the circular or elliptical head frame, making it substantially symmetrical.

Over the past few decades, many improvements have been proposed to adjust the head frame, the handles or the nets of racquets to a certain extent. However, the overall shape and structure of a racquet has not been significantly altered. Overall, a user still has to adjust the way of gripping and swinging the racquet according to the shape of the racquet. The types of balls used with these racquets are relatively limited, due to the limited adaptation of the structure of current racquets.

Therefore, there is a recognized for a racquet that is specifically adapted to the shape and the size of the ball, and the user's comfort level while holding it. Particularly, the prior art is deficient in this respect. The present invention fulfills this long standing need and desire in the art.

SUMMARY OF THE INVENTION

The present invention is directed to a racquet. The racquet comprises a head frame that comprises a curved side portion, a straight top portion and a curved bottom portion. A handle is disposed in opposition to the curved side portion and in a connecting relationship to a distal end of the top portion and distal end of the curved bottom portion. A plurality of openings are disposed through the head frame and a portion of the handle that connects the top portion and the bottom portion and a plurality of strings comprising a net passing through the openings.

The present invention also is directed to a sports racquet. The sports racquet comprises a head frame comprising a curved side portion, a straight top portion and a curved bottom portion, a length of said top portion is greater than a chord of a curve of the bottom portion. A handle is disposed in opposition to the curved side portion and in a connecting relationship to the distal end of top portion and the distal end of the bottom portion. A plurality of slots is disposed through the head frame and a portion of the handle between the top portion and the bottom portion. A net is disposed within the head frame comprising a plurality of strings passing through the slots.

Other and further aspects, features, benefits, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be had by reference to certain embodiments thereof that are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

Figure 1:
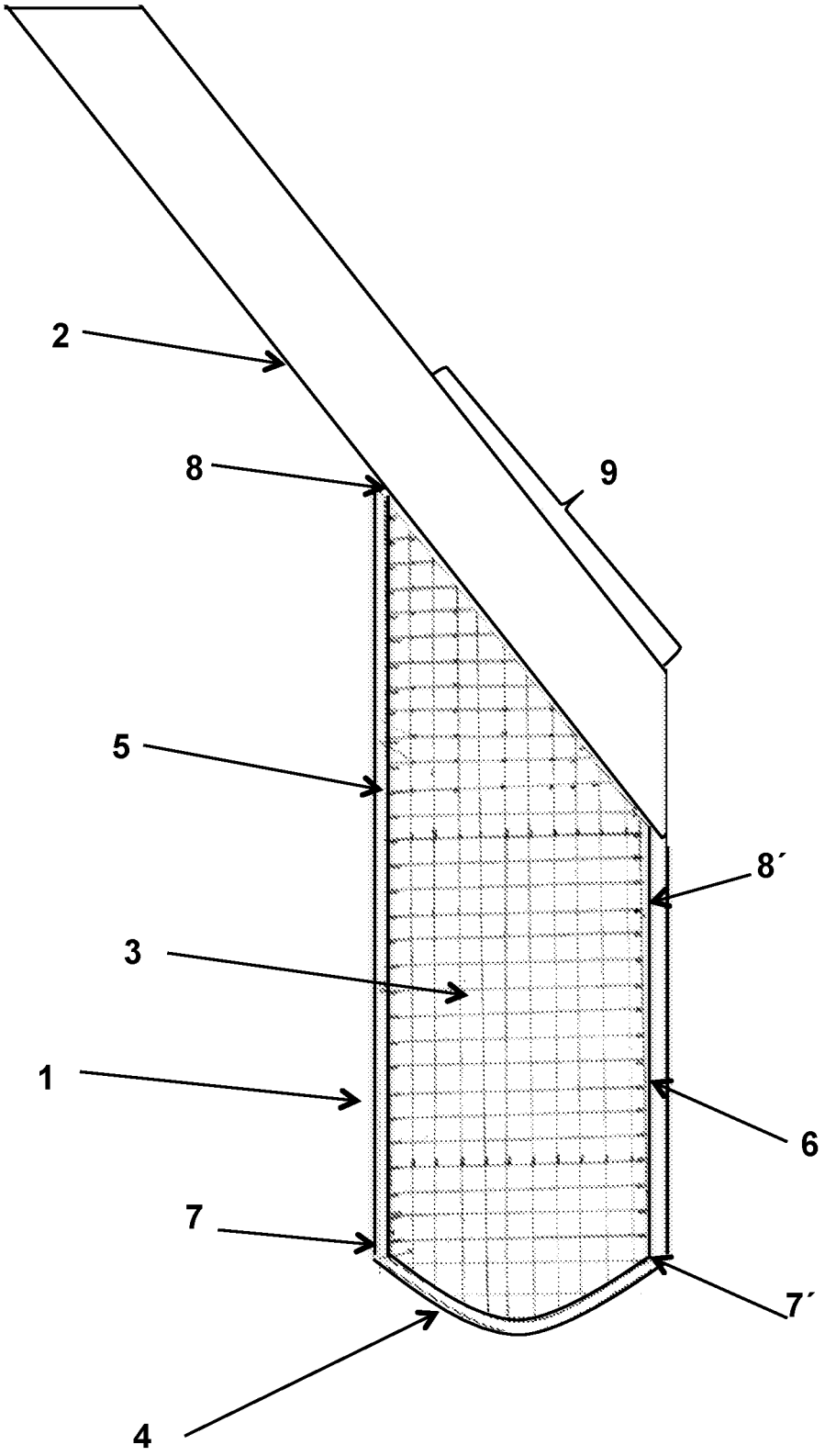
FIG. 1 is the front view of the racquet comprising a head frame with a long side and a short side, a handle and a net disposed within the head frame.

As used herein in the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure.

As used herein, the term "distal" refers to the direction that is away from the top rim of the head frame. The term "proximal" refers to the direction that is close to the top rim of the head frame.

In one embodiment of the present invention, there is provided a racquet comprising a head frame having a curved side portion, a straight top portion and a curved bottom portion; a handle affixed to the head frame in opposition to said side portion between the straight top portion and the curved bottom portion; a plurality of openings equally spaced through the head frame and a portion of the handle; and a plurality of strings comprising a net passing through said openings.

In this embodiment, a length of the top portion may be greater than a chord of a curve of the bottom portion. For example, the length of the top portion may be about 15 inches to about 17 inches. Also, the chord of the curve of the bottom portion may be about 11 inches to about 13 inches. In addition, the distance between a distal end of the top portion and a distal end of the bottom portion may be about 6 inches. Furthermore, an angle between the handle and the distal end of each of the top portion may be about 140° to about 150°.

In this embodiment, the length of the handle may be about 35 inches to about 55 inches. Also the slots may be equally spaced on the head frame of the handle. In addition, the plurality of strings comprising the net may be in a crisscross pattern at substantially perpendicular angles.

In this embodiment an exemplary material for the head frame and handle may include, but is not limited to, wood, aluminum, magnesium, titanium, carbon fiber, graphite, plastic, or combination thereof.

In another embodiment of the present invention, there is a provided a sports racquet comprising a head frame comprising a curved side portion, a straight top portion and a curved bottom portion, a length of the top portion is greater than a chord of a curve of the bottom portion; a handle disposed in opposition to the curved side portion and in a connecting relationship to the top portion and bottom portion; a plurality of slots disposed through the head frame and a portion of the handle between the top portion and the bottom portion; and a net disposed within the head frame comprising a plurality of strings passing through the slots.

In this embodiment, the length of the top portion may be about 15 inches to about 17 inches. Also, the chord of the curve of the bottom portion may be about 11 inches to about 13 inches. In addition the distance between a distal end of top portion and a distal end of the bottom portion may be about 6 inches. Furthermore, an angle between the handle and a distal end of the top portion may be about 140° to about 150°. Further yet, the length of the handle may be about 35 inches to about 55 inches. Further yet, the slots may be equally spaced on the head frame and the handle. Further yet the plurality of strings comprising the net may be in a crisscross pattern at substantially perpendicular angles. The exemplary material that the head frame and handle comprise includes, but is not limited to wood, aluminum, magnesium, titanium, carbon fiber, graphite, plastic or a combination thereof.

In yet another embodiment of the present invention, there is provided a racquet comprising a head frame comprising a curved side rim in a connection relationship with a straight top rim and a straight bottom rim that are substantially parallel to each other; a handle disposed in opposition to the curved side rim and in a connecting relationship to the top and bottom rims; a plurality of slots disposed through the head frame and a portion of the handle that connects the top rim and the bottom rim; and a net disposed within the head frame comprising a plurality of strings passing through the slots.

In this embodiment, the length of the top rim may be greater than the length of the bottom rim. More specifically, the length of the top rim is about 15 inches to about 17 inches. The length of the bottom rim is about 11 inches to about 13 inches. In a preferred embodiment, the distance between the top rim and the bottom rim of the head frame is about 6 inches.

In this embodiment, an angle between the handle and a distal end of each of the top rim and bottom rim may be about 140° to about 150°. The length of the handle is about 35 inches to about 55 inches. In this embodiment, the slots are equally spaced on the head frame and the handle. In a preferred embodiment, the plurality of strings comprising the net are in a crisscross pattern at substantially perpendicular angles. The head frame and handle of the racquet may be made of a material comprising wood, aluminum, magnesium, titanium, carbon fiber, graphite, plastic, or a combination thereof.

In yet another embodiment of the present invention, there is provided a sports racquet comprising a head frame having a curved side rim disposed in a connection relationship with a straight top rim and a straight bottom rim substantially parallel to each other; a handle affixed to the head frame in opposition to the side rim between the straight top rim and the straight bottom rim; a plurality of openings equally spaced through the head frame and a portion of the handle; and a plurality of strings comprising a net passing through the openings.

In this embodiment, the length of the top rim may be about 15 inches to about 17 inches. The length of the bottom rim may be about 11 inches to about 13 inches. In a preferred embodiment, the distance between the top rim and the bottom rim of the head frame is about 6 inches. In this embodiment, an angle between the handle and a distal end of each of the top rim and the bottom rim may be about 140° to about 150°. The length of the handle may be about 35 inches to about 55 inches. In this embodiment, the plurality of strings comprising the net may be in a crisscross pattern at substantially perpendicular angles. The head frame and handle of the racquet may be made of a material comprising wood, aluminum, magnesium, titanium, carbon fiber, graphite, plastic, or a combination thereof.

Provided herein is a racquet, such as a sports racquet, that accommodates the size and shape of the ball for which the racquet is designed to hit. More specifically, the racquet has a wider bottom portion to maneuver the ball without breaking it. The handle of the racquet is affixed to the head frame at an angle of about 140° to improve players' comfort level while holding it and maneuver the ball. The net is made of tightly stretched strings disposed within the head frame in a crisscross pattern with substantially perpendicular angles at the intersection of the strings. The shape and size of the head frame and the angle of the handle of the racquet ensure the user to comfortably and conveniently strike a ball while running on a sports field.

FIG. 1 shows the front view of an example of the racquet of the present invention having representative dimensions. The racquet comprises a head frame 1, a handle 2 and a net 3 disposed within the head frame. The head frame has a curved side rim 4 and straight top 5 and bottom 6 rims. The top rim 5 is longer than the bottom rim 6. Both top and bottom rims have one end 7,7' affixed to the curved rim 4, and the other end 8,8' is affixed to the handle 2. Since the length of the top 5 and bottom 6 rims are not the same, the handle 2 connects with the rims at an angle. The net 3 disposed in the head frame 1 is made of tightly stretched strings. The strings are wired through a plurality of openings or slots 10 disposed on the rims of the head frame 1 and part of the handle 9 that connects the ends 8,8' of the top 5 and bottom 6 rims. The distance between the top rim 5 and the bottom rim 6 of the head frame may be about 6 inches. The top rim 5 may be about 17 inches long and the bottom rim 6 may be about 13 inches long. The handle 2 is about 55 inches long, 2.5 inches wide, and 1 inch thick. Each rim of the head frame is about ½ inch thick and ½ inch wide.

Figure 2:
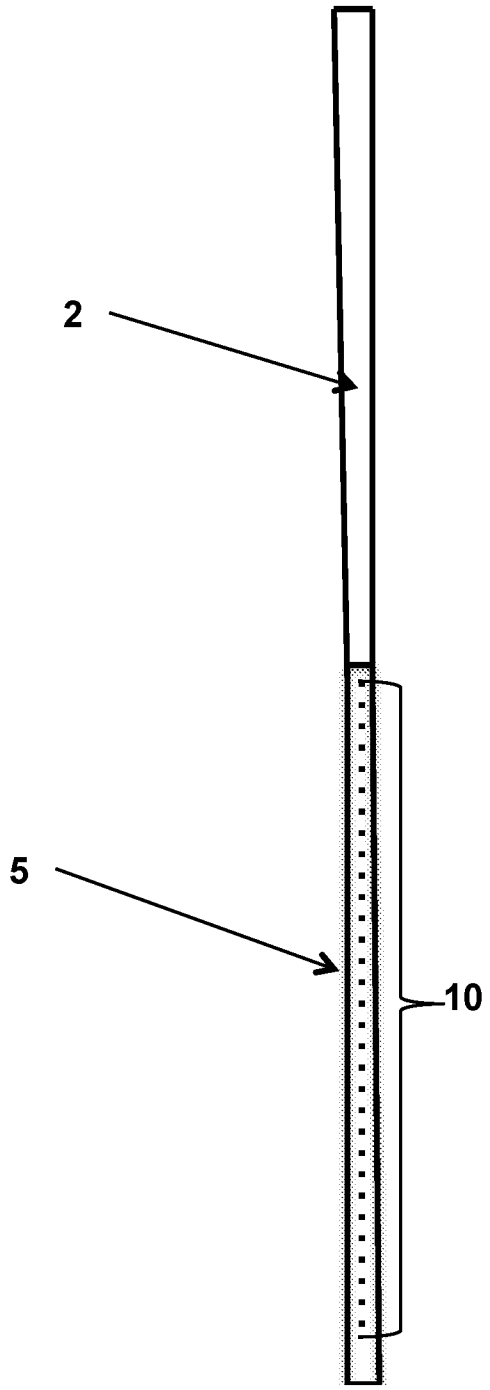
FIG. 2 is the top view of the racquet from the long side of the racquet.

With continued reference to FIG. 1, FIG. 2 illustrates that there are about 32 openings/slots 10 disposed on the top rim 5 of the head frame.

Figure 3:
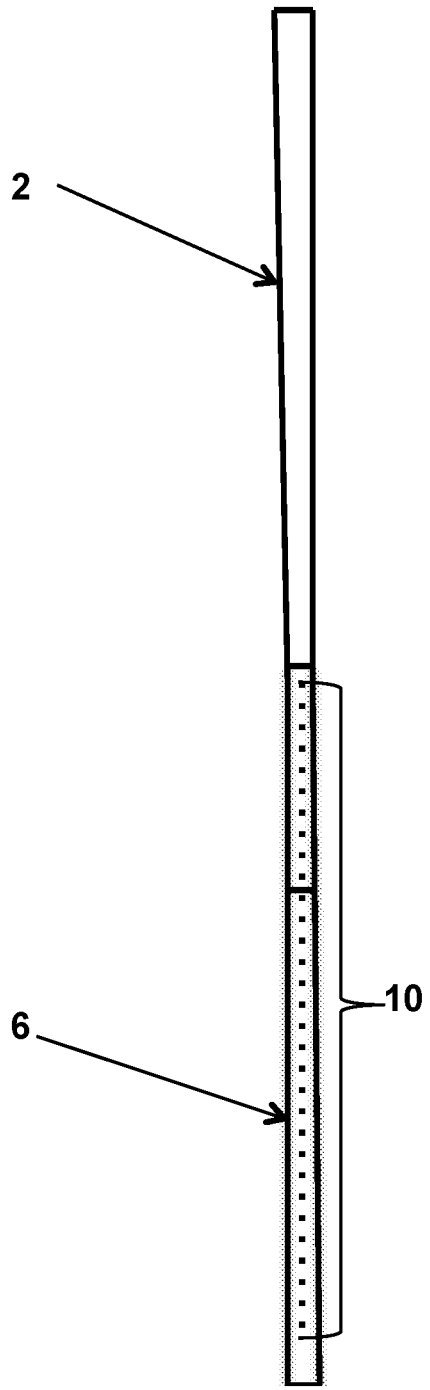
FIG. 3 is the bottom view of the racquet from the short side of the racquet.

With continued reference to FIG. 1, FIG. 3 illustrates that there are about 18 openings/slots disposed on the bottom rim 6 and the proximal end of the handle 2.

Figure 4:
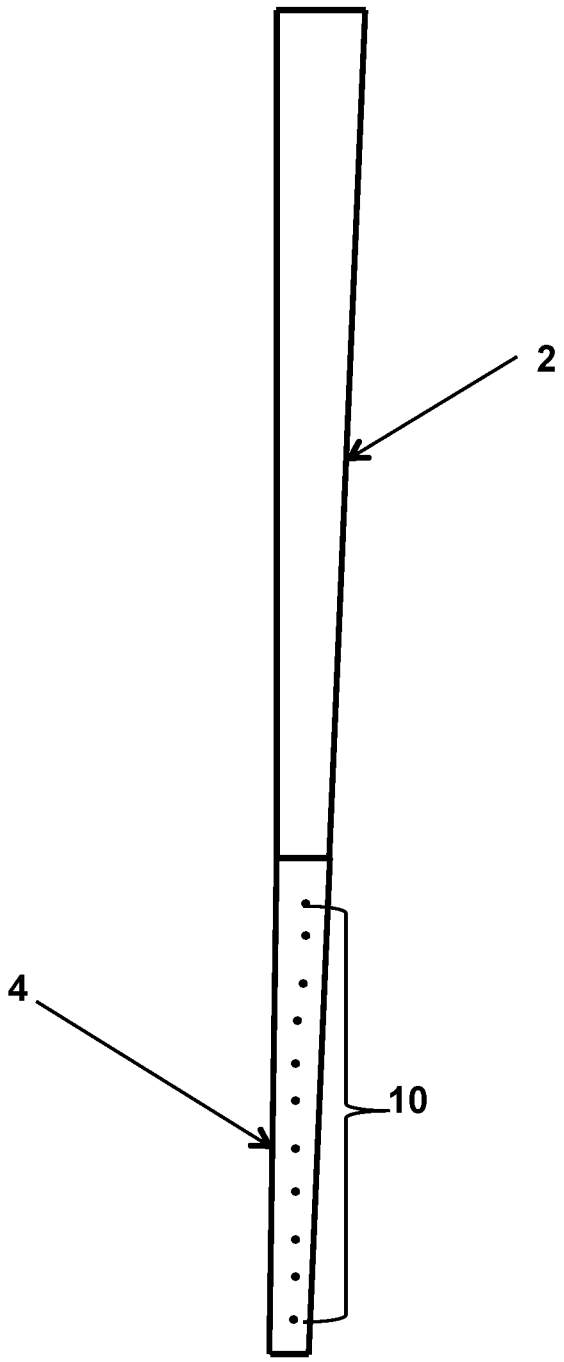
FIG. 4 is the side view from the side of the top rim of the racquet.

With continued reference to FIG. 1, FIG. 4 illustrates there are about 10 openings/slots disposed on the curved side rim 4.

Figure 5:
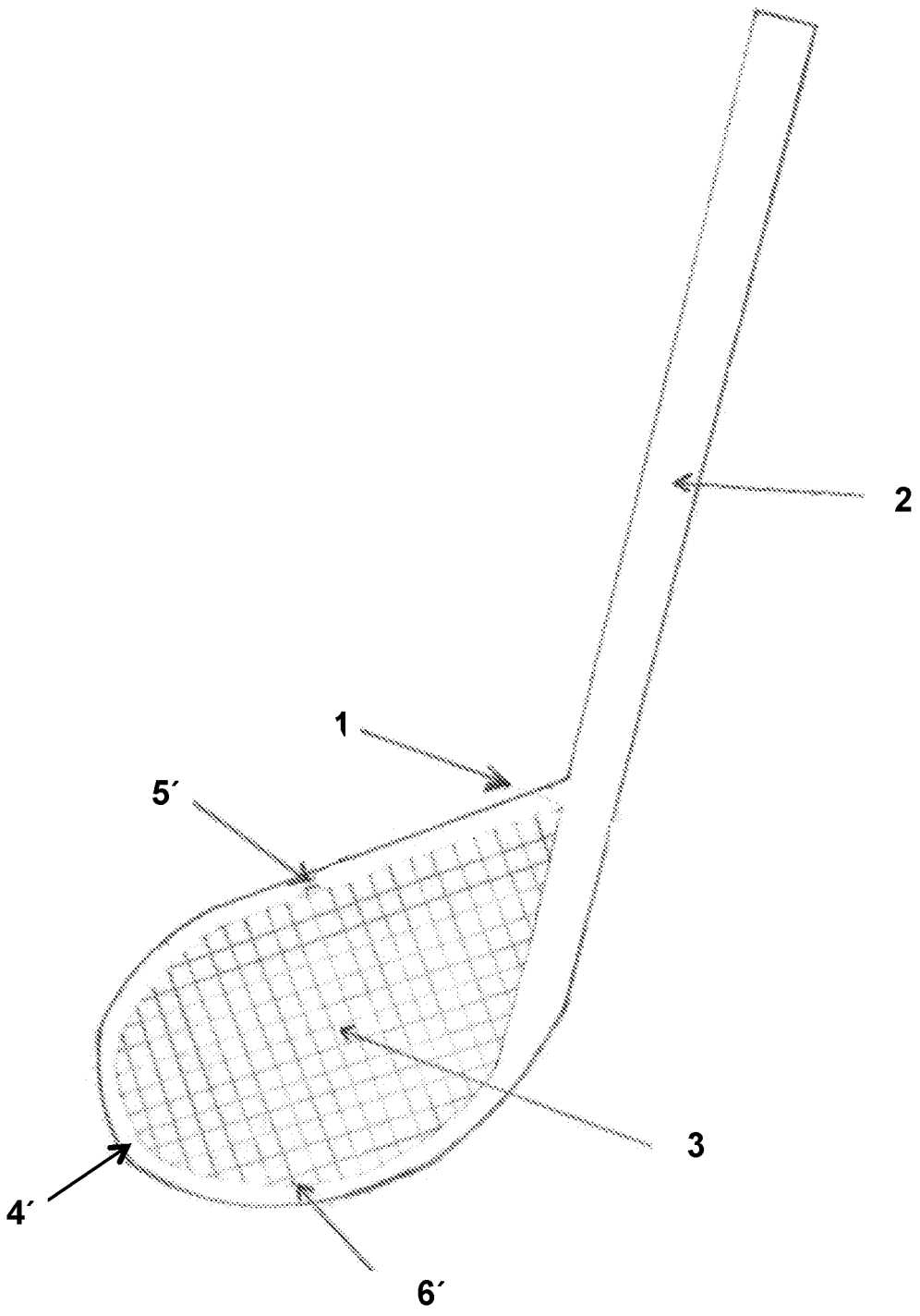
FIG. 5 is the front view of the sports racquet with the head frame comprising a curved side portion, a straight top portion and a curved bottom portion.

In FIG. 5, in an alternative embodiment, the head frame may comprise a curved side portion 4', a straight top portion 5' and a curved bottom portion 6'. Similarly, the distal end of the top portion and the distal end of the bottom portion end are affixed to the handle 2. The top portion is longer than the chord of the curve of the bottom portion such that the handle and the top portion is intersect at an angle of about 140° to 150°. The length of the top portion is about 15 inches to 17 inches. The chord of the curve of the bottom portion is from about 11 inches to 13 inches. The distance between the distal end of the top portion and the distal end of the bottom portion is about 6 inches. The overall length of the handle is about 35 inches to 55 inches.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention.

What is claimed is:

1. A racquet, consisting of:

a head frame having a curved side portion, a straight top portion, and a curved bottom portion;

a handle with a length of about 35 inches to about 55 inches that is affixed to the head frame in opposition to said side portion between the straight top portion and the curved bottom portion at an angle of about 140° to about 150° with a distal end of the top portion such that an axis along the length of the handle extends outside the head frame;

a plurality of openings equally spaced through the head frame and a portion of the handle; and a plurality of strings comprising a net passing through said openings.

2. The racquet of claim 1, wherein a length of said top portion is greater than a chord of a curve of the bottom portion.

3. The racquet of claim 2, wherein the length of said top portion is about 15 inches to about 17 inches.

4. The racquet of claim 2, wherein the chord of the curve of the bottom portion is about 11 inches to about 13 inches.

5. The racquet of claim 1, wherein a distance between a distal end of the top portion and a distal end of the bottom portion is about 6 inches.

6. The racquet of claim 1, wherein said plurality of strings comprising the net are in a crisscross pattern at substantially perpendicular angles.

7. The racquet of claim 1, wherein said head frame and handle are made of a material comprising wood, aluminum, magnesium, titanium, carbon fiber, graphite, plastic, or a combination thereof.

8. A sports racquet, consisting of:

a head frame comprising a curved side portion, a straight top portion, and a curved bottom portion, a length of said top portion is greater than a chord of a curve of the bottom portion;

a handle with a length of about 35 inches to about 55 inches that is disposed in opposition to said curved side portion and in a connecting relationship with the top portion and bottom portion at an angle of about 140° to about 150° with a distal end of the top portion such that an axis along the length of the handle extends outside the head frame;

a plurality of slots disposed through the head frame and a portion of the handle between the top portion and the bottom portion; and a net disposed within the head frame comprising a plurality of strings passing through said slots.

9. The racquet of claim 8, wherein the length of said top portion is about 15 inches to about 17 inches.

10. The racquet of claim 8, wherein the chord of the curve of said bottom portion is about 11 inches to about 13 inches.

11. The racquet of claim 8, wherein a distance between a distal end of top portion and a distal end of the bottom portion is about 6 inches.

12. The racquet of claim 8, wherein said slots are equally spaced on the head frame and the handle.

13. The racquet of claim 8, wherein said plurality of strings comprising the net are in a crisscross pattern at substantially perpendicular angles.

14. The racquet of claim 8, wherein said head frame and handle are made of a material comprising wood, aluminum, magnesium, titanium, carbon fiber, graphite, plastic, or a combination thereof.

* * * * *